United States Patent [19]

Towfigh

[11] 4,139,101

[45] Feb. 13, 1979

[54] SPACE DIVIDER OR THE LIKE WITH IMPROVED COLLAPSIBLE JOINT CONSTRUCTION

[76] Inventor: Keivan Towfigh, 51 Harvard Ave., Medford, Mass. 02155

[21] Appl. No.: 753,724

[22] Filed: Dec. 23, 1976

[51] Int. Cl.[2] ..... A47G 5/00

[52] U.S. Cl. ..... 211/86; 211/100; 211/182; 248/293; 403/61

[58] Field of Search ..... 211/100, 101, 99, 96, 211/193, 86, 170, 171, 172, 182; 248/240.4, 240, 242, 287, 293; 403/61, 517; 16/179; 160/336

[56] References Cited

U.S. PATENT DOCUMENTS

| | | | |
|---|---|---|---|
| 1,466,039 | 8/1923 | Burcsak | 403/113 X |
| 2,855,041 | 10/1958 | Blashfield | 211/96 X |
| 3,186,561 | 6/1965 | Strässle | 211/182 |
| 3,249,233 | 5/1966 | Marcus et al. | 211/172 X |
| 3,496,889 | 2/1970 | Protzmann | 16/179 X |
| 3,513,606 | 5/1970 | Jones | 211/182 X |
| 3,850,401 | 11/1974 | Snediker | 211/101 X |

FOREIGN PATENT DOCUMENTS

| | | | |
|---|---|---|---|
| 205948 | 1/1909 | Fed. Rep. of Germany | 160/336 |
| 458680 | 7/1950 | Italy | 211/96 |
| 443595 | 2/1968 | Switzerland | 211/193 |

*Primary Examiner*—Roy D. Frazier
*Assistant Examiner*—Robert W. Gibson, Jr.
*Attorney, Agent, or Firm*—Wolf, Greenfield & Sacks

[57] ABSTRACT

A standard and a boom extending from the standard are connected by a mechanism to permit the boom to be pivoted between an upright, locked position and a lowered, collapsed position. A connecting device is employed to attach the boom mechanism to the standard which permits heightwise adjustment of the boom on the standard. The connecting mechanism includes a member having an L-shaped slot which receives a pair of pins extending from the boom. The length of one of the legs of the L-shaped slot is at least equal to the spacing between the pins and the other leg of the slot is longer than the spacing between the pins to lock the device in position when the pins are disposed in the other leg of the slot. The invention is disclosed as being used with a space divider such as a curtain which can be hung from the boom.

5 Claims, 10 Drawing Figures

FIG. 1
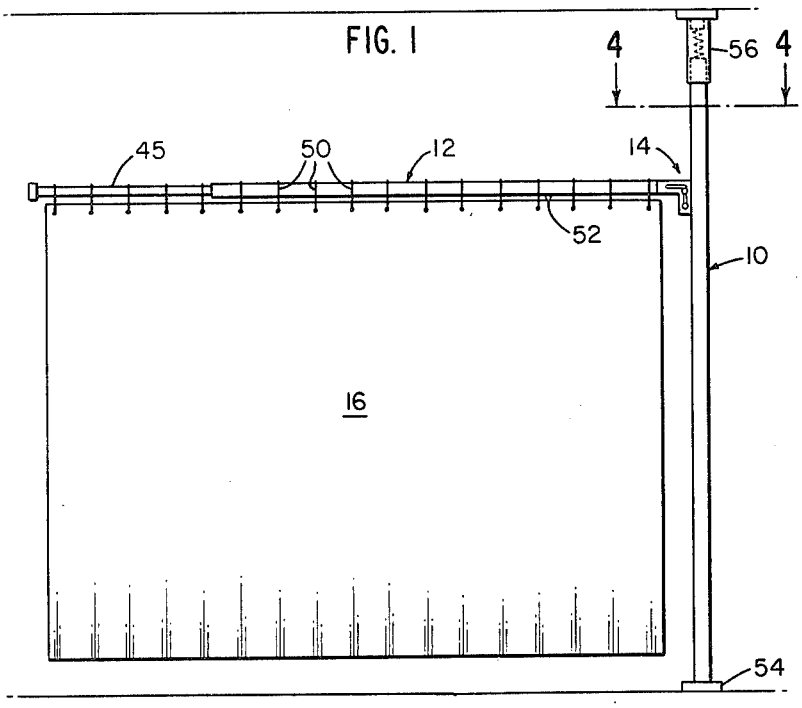
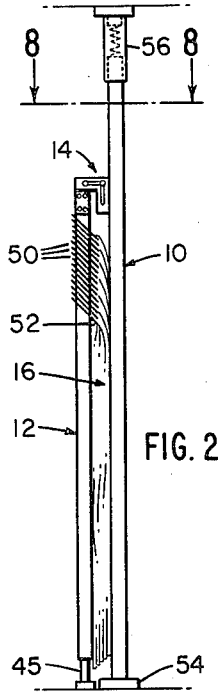
FIG. 2
FIG. 3
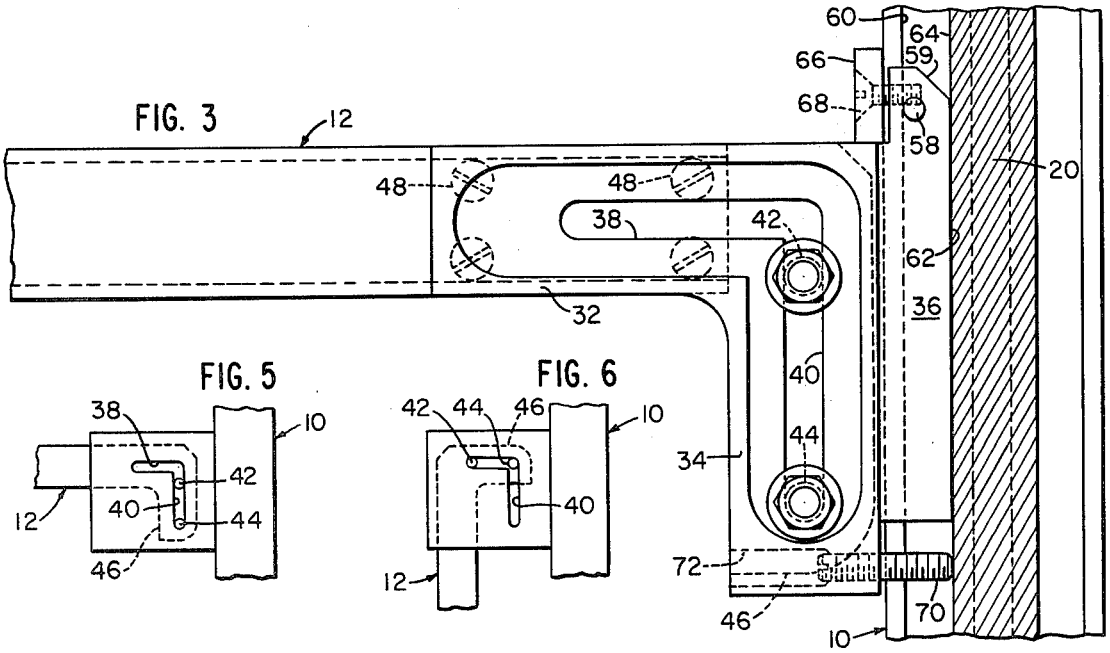
FIG. 5
FIG. 6
FIG. 4
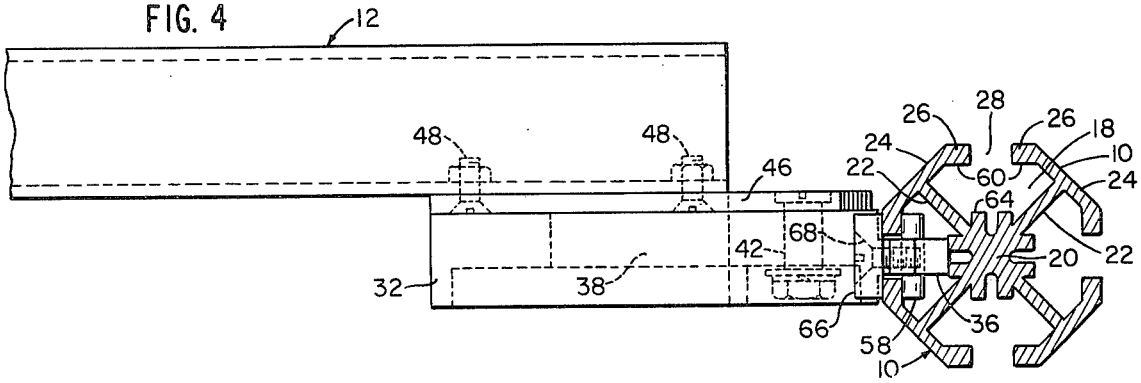

FIG. 9
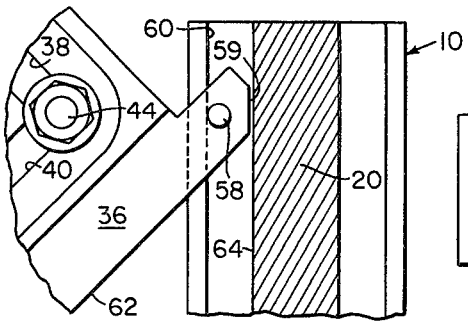
FIG. 7
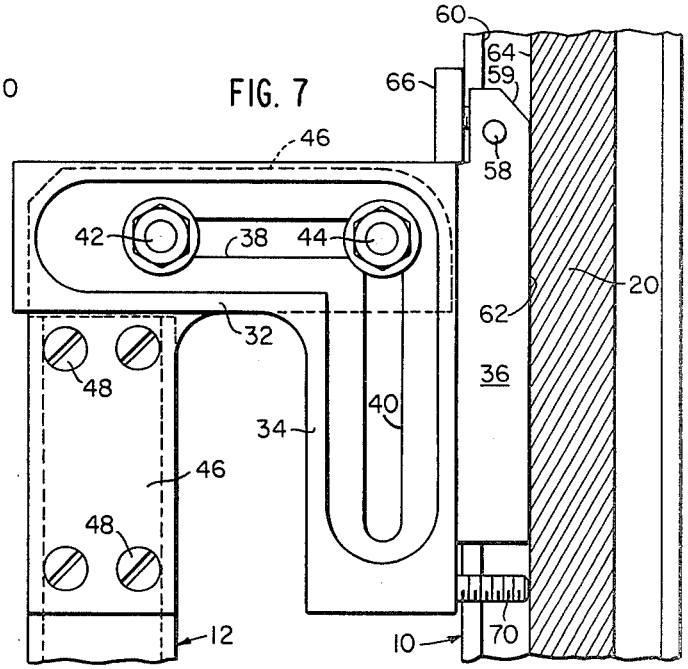
FIG. 8
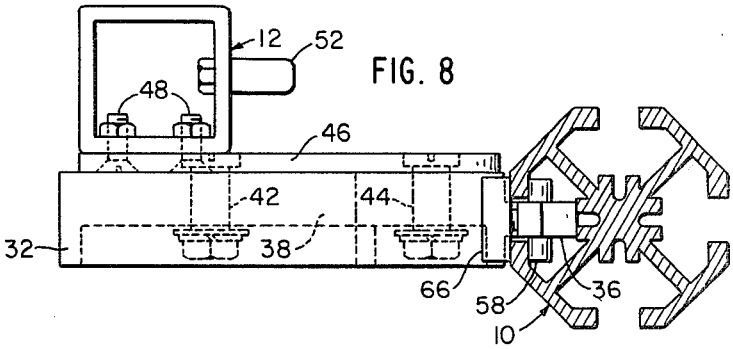
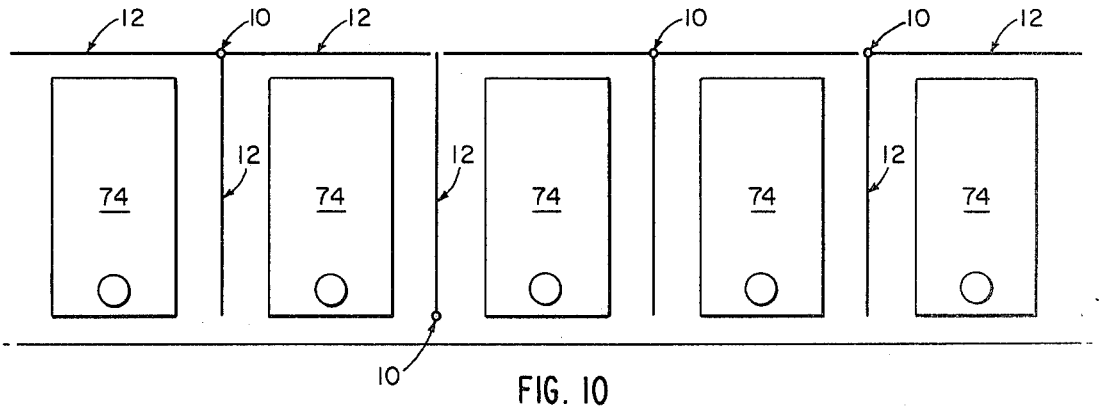
FIG. 10

SPACE DIVIDER OR THE LIKE WITH IMPROVED COLLAPSIBLE JOINT CONSTRUCTION

BACKGROUND AND SUMMARY OF THE INVENTION

This invention relates to improvements in collapsible, relatively portable standards and booms which may, for example, be used as space dividers by hanging curtains or the like from the extended booms. The invention also is concerned with an improved connection between the standard and boom which permits it to be pivoted between an upright and a collapsed position.

The invention may be used in a number of environments, for example, in hospital wards, to divide the individual bed areas from each other. Presently, when a number of adjacent beds in a room or ward are divided, this is done by hanging curtains by special tracks mounted to the ceiling of the room. Typically, these tracks assume an L-shaped configuration for each bed, extending along one side of the bed and across the foot of the bed. Among the difficulties with this practice is that the installation is comparatively permanent and that in the event it is desired to change the arrangement of beds, it then becomes necessary to detach the permanent tracks from the ceiling and, if possible, rearrange them to fit the new bed plan. This, of course, is time consuming, awkward and expensive in addition to the increased initial expense of the tracks. Other techniques have been proposed, for example, to attach a boom to the wall of the room and suspend a curtain from the boom. This approach also suffers from a number of the same difficulties encountered with the overhead track type of installation. They do not lend themselves to portability or easy rearrangement. Also, with the wall mounted booms, they have required special supporting structures to hold the weight of the curtain.

In brief, the present invention relates to a portable vertical standard from which a plurality of radial extending booms may be mounted. Each of the booms is attached to the standard by a specially constructed connection which permits the boom to be locked in its up, curtain-suspending position or, alternatively, to be folded to a downward position in which the boom parallels the standard. Means are provided to retain the curtain on the boom even when it is in its collapsed configuration. The boom is attached to the standard by a special connector including an L-shaped slot in which one leg of the slot is longer than the other. The slot receives a pair of spaced pins which extend from the boom. The boom may be locked in its upright position by raising it and permitting the spaced pins to fall into the vertically extending longer leg of the L-shaped slot. Means also are provided to enable the position of the connector and, therefore, the boom, to be varied along the length of the standard. If desired, the entire connection and the boom can be removed easily from the standard.

It is among the general objects of the invention to provide an improved connector between a standard and a boom which permits the boom to be locked in a raised position or, aternatively, collapsed.

Another object of the invention is to provide an improved connector of the type described which is of rugged, durable construction, has a minimal number of moving parts and which requires no supplemental reinforcing structure.

A further object of the invention is to provide an improved portable space divider.

DESCRIPTION OF THE DRAWINGS

The foregoing and other objects and advantages of the invention will be appreciated more fully from the following further description thereof, with reference to the accompanying drawings wherein:

FIG. 1 is an elevation of a space divider in accordance with the invention with the boom in its upright position;

FIG. 2 is an illustration of the device shown in FIG. 1 with the boom in its collapsed position and illustrating the curtain remaining attached to the boom;

FIG. 3 is an enlarged side elevation, partly in section, of the connection between the boom and the standard;

FIG. 4 is a plan view of the arrangement shown in FIG. 3;

FIG. 5 is a diagrammatic illustration of the manner of operation of the connector illustrating its position when the boom is upright;

FIG. 6 is an illustration similar to FIG. 5 showing the configuration of the connector when the boom is collapsed;

FIG. 7 is an enlarged side elevation of the connector and a portion of the boom, similar to FIG. 3, when the boom is collapsed;

FIG. 8 is a view of the arrangement shown in FIG. 7 and as seen along the line 8—8 of FIG. 2;

FIG. 9 is a sectional elevation through the standard and a portion of the connector illustrating the manner in which the connector is attached to the standard; and FIG. 10 is a diagrammatic, plan illustration of the manner in which the invention may be employed to divide a number of hospital beds from each other.

DESCRIPTION OF THE PREFERRED EMBODIMENT

FIG. 1 shows one embodiment of the invention which includes a vertically mounted standard 10, a boom 12 extending from the standard 10 and a connector 14 between the standard 10 and boom 12. The device is illustrated as supporting a curtain 16 from the boom. FIG. 2 illustrates the device in its folded configuration in which the boom 12 has been lowered to its vertical position, parallel to the standard 10.

The standard 10 preferably is of the type suggested in FIGS. 4 and 8 which is capable of supporting a plurality of radially extending booms or similar types of extensions. In the embodiment shown, the standard 10 may be extruded, for example, from aluminum and defines four longitudinally extending channels, each indicated by the reference character 18. The standard 10 includes a central core 20 which has four radial walls 22 extending from the core. The outer ends of the radial walls 22 include outer wall members 24. The adjacent ends of adjacent wall members 24 are spaced to define flanges 26 which, in turn, cooperate to define longitudinally extending slots 28. Each of the channels 18 can receive a portion of a boom connector 14 in a manner which will be described.

The boom connector 14 includes an L-shaped main support bracket 30 having horizontal and vertical legs 32, 34 respectively. The main support bracket 30 is attached to the standard 10 by means of a vertical flange 36 which extends through a slot 28 in the standard 10 and into a channel 18. The flange 36 and integral bracket 30 are secured to the standard as herein described.

An L-shaped slot is formed transversely through the bracket 30 to define a horizontal slot portion 38 and a vertical slot portion 40. The L-shaped slot receives a pair of spaced pins or bolts 42, 44. The pins 42, 44 are attached to the boom 12 and cooperate with the L-shaped slot alternately to lock the boom in its raised position or to permit the boom to be lowered to the position shown in FIG. 2. Preferably, the boom 12 is connected to the pins 42, 44 by an intermediate L-shaped mounting plate 46. The pins 42, 44 are secured to one leg of the mounting plate 46 and the boom 12 is secured to the other leg of the mounting plate 46, for example, by screws or bolts 48. In this regard, it may be noted that the boom 12 is shown as being of hollow rectangular construction, with the screws or bolts 48 being secured to one of the faces of the boom 12.

The spacings between the pins 42, 44 and the length of the horizontal and vertical slots 38, 40 are such that when the boom is in its raised position, shown somewhat diagrammatically in FIG. 5, the boom will remain locked and supported in that position. To this end, the vertical slot 40 is longer than the distance between the pins 42, 44. Thus, when the boom is raised to its horizontal position and the pins 42, 44 are in alignment with the vertical slot 40, the boom and the pins 42, 44 can be lowered bodily, slightly until the lower pin 44 rests in the lower end of the vertical slot 40 and the upper pin 42 will be disposed fully within the vertical slot 40. The connector mechanism thus is self-locking in a very simple, yet efficient manner. In order to lower the boom 12 to the position shown in FIG. 2 (and diagrammatically in FIG. 6), the boom need only be raised slightly to re-align the upper pin 42 with the horizontal slot 38. The boom then can be pivoted downwardly until the pins 42, 44 assume the configuration shown in FIGS. 6, 7 and 8. The length of the slot 38 is at least equal to the end to end distance of the pins 42, 44.

The boom 12 may have a telescoping extension 45 at its outer end to enable the effective length of the boom to be greater than its height above the floor. When the device is collapsed, the extension 45 is simply retracted into the boom 12 as suggested in FIG. 2. The extension 45 may be spring biased outwardly so as to extend automatically when the boom is raised.

Means also are provided to retain the curtain on the boom even as it is dropped to its lowered position. In this regard, it should be noted that the curtain 16 preferably is suspended from the boom by a plurality of conventional curtain hooks which are movable along the boom 12. The boom 12 is provided with a downwardly extending projection or lug 52. The lug 52 is spaced from the connector end of the boom a distance which will permit the curtain hooks to be brought together between the lug 52 and the connector 14. After the curtain has been thus drawn, the boom is raised slightly to release the locking mechanism of the connector 14 and is then pivoted downwardly. As the boom pivots downwardly, the curtain hooks 50 will assume an inclined attitude as suggested in FIG. 2 and the lowermost of the hooks 50 will engage and be supported by the lug 52 as shown in FIG. 2.

The standard 10 may be secured in its vertical position by any number of means. In the illustrative embodiment of the invention, the standard is provided with a foot 54 which rests on the floor. The upper end of the standard 10 may be firmly secured to the ceiling or other overhead member by a cap 56 which is slidable longitudinally with respect to the standard and which may be spring biased upwardly away from the standard 10. With the system shown, it is quite easy to remove the entire device after the boom 12 has been folded down. This provides a very portable and versatile system which is among the objects of the invention. If desired the standard 10 could also be wall mounted.

The support bracket 30 is attached to the standard 10 in a manner which permits the height of the connector 14 to be selected in accordance with the particular environment in which the device is used. As shown more clearly in FIGS. 4 and 8, the width of the flange 36 is slightly less than the width of the entry slot 28. A transversely extending pin 58 is attached to the upper end of the flange 36 and, when the flange 36 is disposed in the channel 18, the transversely extending ends of the pin 58 bear firmly against the inwardly facing surfaces 60 of the standard flanges 26. When in its secured position, the rearwardly facing surface 62 of the mounting flange 36 bears firmly against the innermost surface 64 of the standard core 20. The depth of the channel 18 and the dimensions and location of the pin 58 with respect to the rear surface 62 of the channel 36 are such that the parts become wedged firmly together.

The connector 14 is initially attached to the standard 10 by inserting it into a receptive channel 18 at the end of the standard. FIG. 9 shows the attitude in which the upper end of the flange 36 and transverse pin 58 are inserted into the channel. The flange 36 then is urged along the channel to its intended position on the standard and is then pivoted to the wedged position shown in FIG. 3. In order to facilitate insertion and movement of the upper end of the flange 36 along its channel 18, the upper outer corner of the flange 36 is beveled as suggested at 66.

In addition to the wedging of the pin 58 and flange 36 to the standard, a supplemental lock may be provided. To this end, a locking plate 66 may be attached by a screw 68 to the upper end of the flange 36, which protrudes above the top of the horizontal leg 32 of the bracket 30. By tightening the screw 68, the locking plate 66 is urged firmly against the outer surface of the standard flanges 26.

Means also are provided to make slight variations in the angular attitude of the connector 14 with respect to the standard 10. To this end, a set screw 70 is threaded through the lower end of the vertical leg 34 of the bracket 30. The set screw passes through the slot 28 in the standard and bears firmly against the inner surface 64 of the standard core 20. A bore 72 is provided through the leg 34 to provide access to the outer end of the set screw 70.

FIG. 10 illustrates but one of numerous manners in which the invention may be employed to divide a number of beds 74 from each other. It will be appreciated that additional bed spaces could be provided by adding other booms and curtains to the standards already provided. A high degree of flexibility is obtained.

It should be understood that the foregoing description is intended merely to be illustrative of the invention and that other modifications and embodiments thereof may be apparent to those skilled in the art without departing from its spirit.

Having thus described the invention, what I desire to claim and secure by Letters Patent is:

1. In an arrangement of a first member and a second member in which the first member is connected to the second member for generally pivotal movement between a raised, extended position and a downwardly extending collapsed position, an improved connecting device comprising:

a connector member;

means for securing the connector member to the second member;

said connector member having a pair of slots formed therein, said slots being angularly spaced and meeting at a juncture, one of said slots being longer than the other of said slots, said connector being oriented so that one of said slots extends generally downwardly from the juncture;

a pair of pins attached to said first member, said pins extending through the slots in the connector member;

said pins being spaced by an amount which is less than the length of said one of said slots whereby when said first member is disposed at an angle with respect to said second member the pins will be in alignment with said one of said slots and both of said pins may be advanced downwardly into said one slot to lock the first member in said extended position.

2. A device as defined in claim 1 further comprising:

said pair of slots defining an L-shaped configuration;

said pins being attached to the first member by means comprising an L-shaped plate having a pair of legs;

said pins being mounted to one of said legs; and said first member being mounted to the other of said legs.

3. A device as defined in claim 2 further comprising:

said connector member being substantially L-shaped and having said one slot formed in one leg of the connector member, said leg having means for attachment to said second member.

4. A device as defined in claim 3 wherein said second member comprises a vertically extending standard and wherein said means for attaching the L-shaped connector member to said standard comprises:

said leg of said L-shaped connector member having a longitudinally extending flange receptive in a channel formed in said standard, said flange being movable lengthwise along the standard to vary its position on the standard; and means for locking the flange to the standard in a selected position along the standard.

5. A device as defined in claim 4 further comprising:

means for varying the angular attitude of the L-shaped connector member with respect to the standard within a predetermined range and for locking the L-shaped member in said selected attitude.

* * * * *